United States Patent [19]

Ridgeway

[11] 4,050,396

[45] * Sept. 27, 1977

[54] PORTABLE WATER BAILING DEVICE FOR A BOAT

[76] Inventor: Rex L. Ridgeway, 1301 S. D St., Fairfield, Iowa 52556

[ * ] Notice: The portion of the term of this patent subsequent to Mar. 6, 1993, has been disclaimed.

[21] Appl. No.: 663,082

[22] Filed: Mar. 2, 1976

Related U.S. Application Data

[63] Continuation of Ser. No. 537,333, Dec. 30, 1974, Pat. No. 3,941,073.

[51] Int. Cl.[2] ..... F04B 49/04

[52] U.S. Cl. ..... 114/183 R; 417/40

[58] Field of Search ..... 114/183 R, 184; 417/40

[56] References Cited

U.S. PATENT DOCUMENTS

| | | | |
|---|---|---|---|
| 2,669,934 | 2/1954 | Lovett | 417/40 |
| 2,739,536 | 3/1956 | Schaefer | 417/40 |
| 2,829,598 | 4/1958 | Zimmermann et al. | 417/40 |
| 2,981,196 | 4/1961 | Zimmermann et al. | 417/40 |
| 3,272,134 | 9/1966 | Wilburn | 417/40 |
| 3,316,845 | 5/1967 | Schumann | 417/40 |
| 3,941,073 | 3/1976 | Ridgeway | 114/183 R |

*Primary Examiner*—Trygve M. Blix
*Assistant Examiner*—Charles E. Frankfort
*Attorney, Agent, or Firm*—Zarley, McKee, Thomte & Voorhees

[57] ABSTRACT

The portable water bailing device of the present invention includes a housing having a plurality of openings therein adjacent the lower end thereof. Within the housing is a water pump connected to a tube for directing the water from the bottom of the boat outwardly over the edges thereof. The water pump is driven by a direct current motor which is connected in series with a battery. Also in series with the battery and motor is a limit switch which is actuated by a float within the housing. As the water rises within the housing, the float actuates the switch which in turn actuates the pump.

1 Claim, 4 Drawing Figures

PORTABLE WATER BAILING DEVICE FOR A BOAT

The present application is a continuation of Ser. No. 537,333 filed Dec. 30, 1974 now U.S. Pat. No. 3941073.

SUMMARY OF THE INVENTION

This invention relates to a portable water bailing device for boats.

Many water bailing devices have been provided for boats, but they are either manually operated or are extremely complicated and cumbersome in construction. Many of these prior devices include alternating current motors which must be connected to an outside source of electricity. These alternating current devices are not usually portable and must be connected to a wall plug or other outside source of electricity.

The present invention provides a simple portable device which may be placed in the bottom of the boat for removing the water therefrom. The device is automatic and is triggered by a rise of water in the bottom of the boat. The device is operated by direct current and therefore does not require a wall outlet as is the case with many presently known devices for bailing water out of boats.

Therefore, a primary object of the present invention is the provision of a portable water bailing device for a boat.

A further object of the present invention is the provision of a device which may be utilized in the boat when the boat is not readily accessible to a source of alternating current.

A further object of the present invention is the provision of a device which may be utilized in the boat when the motor is not operating and when the boat is away from shore.

A further object of the present invention is the provision of device which may be easily to moved to various portions of the boat wherever it is needed.

A further object of the present invention is the provision of a device which is economical to manufacture, durable in use, and attractive in appearance.

BRIEF DESCRIPTION OF THE VIEWS OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which:

DETAILED DESCRIPTION

Figure 1:
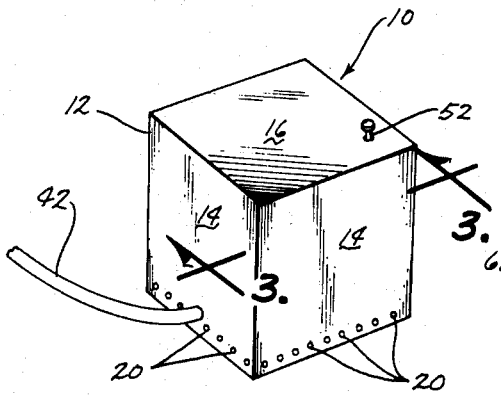
FIG. 1 is a perspective view of the device.

Referring to the drawings, the water bailing device of the present invention is generally designated by the numeral 10. Device 10 includes a housing 12 having a plurality of vertical side walls 14, a top wall 16, and a bottom wall 18. Bottom wall 18 is spaced slightly upwardly from the lower edges of side walls 14. A plurality of side apertures 20 extend through the lower edges of side walls 14 so as to provide communication to the lower surface of bottom wall 18. Bottom wall 18 includes a plurality of apertures 22 therein for permitting water to enter into the interior of compartment 24 which is formed by housing 12. A pump inlet opening 26 is also provided in bottom wall 18.

Within compartment 24 is a pump 28 comprising a pump housing 30 having a cylindrical chamber 32 therein. Rotatably mounted within cylindrical chamber 32 is a rotor blade 34 which rotates about the cylindrical axis/of chamber 32 and which is connected to a direct current motor 36.

Cylindrical chamber 32 of pump 28 includes an inlet opening 38 at opening which is in registered alignment with pump inlet opening 26 of bottom wall 18. Chamber 32 also includes a tangentially extending outlet opening 40 which is connected to a tube 42.

Figure 2:
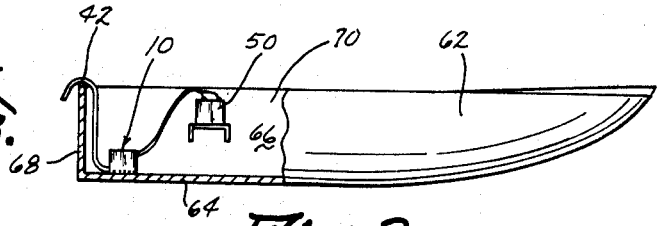
FIG. 2 is a sectional view of the device as used in the bottom of a boat.
Figure 3:
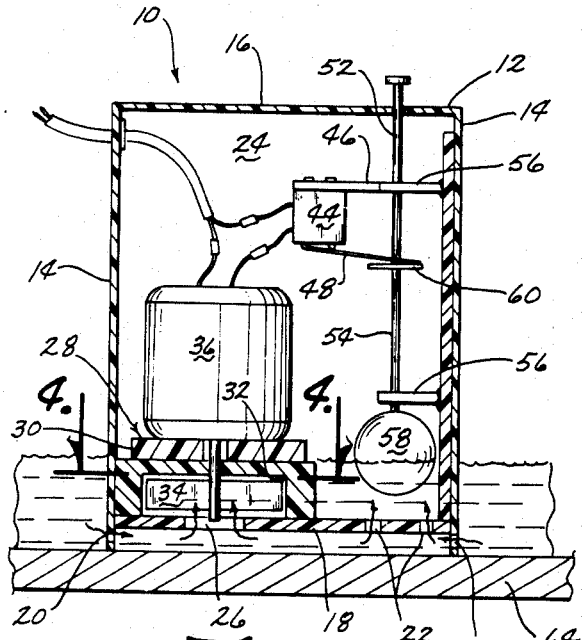
FIG. 3 is a sectional view taken along line 3—3 of FIG. 1.
Figure 4:
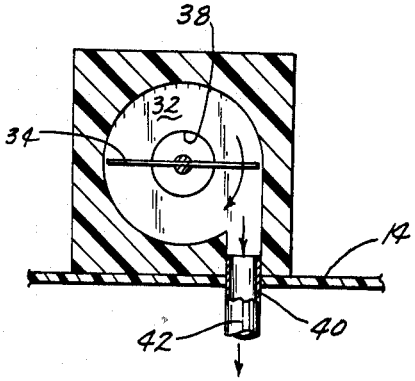
FIG. 4 is a sectional view taken along line 4—4 of FIG. 3.

Also within compartment 24 is a limit switch 44 held in position by a bracket 46. Limit switch 44 includes a switch arm 48. Switch 44 is normally biased to an open position, but switch arm 48 may be moved upwardly to cause switch 44 to move to a closed position. Switch 44 and DC motor 36 are connected in series with a battery 50 (FIG. 2).

A float device 52 is also mounted within housing 12. Float device 52 includes a vertically extending rod 54 which is slidably mounted to a pair of brackets 56 for vertical sliding movement. The lower end of rod 54 includes a float 58, and the upper end of rod 54 extends outwardly through top wall 16 of housing 12. A flange 60 is positioned intermediate the ends of rod 54 adjacent switch arm 48. Rod 54 is movable from a lower position wherein switch 44 is in an open position to an upper position wherein flange 60 lifts switch arm 48 upwardly and moves switch 44 to its closed position.

In operation, device 10 is placed in the bottom of a boat 62 having a bottom wall 64, side walls 66, a transom 68 and gunwales 70. Device 10 is positioned so that the bottom edges of its walls are in communication with any water that may be in the bottom of the boat. The device is connected to a direct current power source such as battery 50 and tube 42 is positioned so that it extends upwardly over the transom or gunwales of the boat. Because switch 44 is normally in an open position, the device is not actuated unless the water within compartment 24 rises sufficiently high to lift float 58 to its upper position. When float 58 moves to its upper position, it causes switch 44 to move to its closed position, thereby actuating the motor 36 and pump 28. As pump 28 lowers the water within the boat, the water lowers correspondingly within compartment 24 thereby causing float 58 to lower and return switch 44 to its open position.

The device of the present invention may be moved anywhere in the boat where it is desirable to remove water. It is easily protable, and it has a minimum of weight. Furthermore, the device may be utilized anywhere that the boat may be, whether it be at a dock or whether it be out away from shore. The device operates automatically and does not require that the owner be present. Thus it may be placed in the boat when the owner is away from the boat, and it will automatically remove the water therefrom. Thus it can be seen that the device accomplishes at least all of its stated objectives.

What is claimed is:

1. A portable water bailing device for a boat having a bottom wall and gunwales above said bottom wall, said device comprising; a housing having sidewalls, a top wall and a bottom wall forming a compartment, said bottom wall being spaced upwardly from the lower edges of said sidewalls, said lower edges of said sidewalls being provided with a plurality of aperatures therein positioned below said bottom wall;

a water pump mounted within said housing, said water pump having a cylindrical chamber therein with an inlet opening and an outlet opening, said outlet opening extending tangentially outwardly from the cylindrical wall of said cylindrical chamber;

said housing having at least one opening at the lower end thereof for permitting water to enter said compartment;

a flat blade being rotatably mounted within said cylindrical chamber of said pump for rotation about the cylindrical axis of said chamber;

a direct current motor drivingly connected to said blade;

a limit switch within said compartment and movable between open and closed positions, said limit switch being normally biased toward to its open position;

said limit switch having a switch arm thereon which is movable upwardly to cause said switch to move to said closed position;

a direct current power source connected in series with said limit switch and said direct current motor;

float means movably mounted within said compartment for vertical movement from a lower position to an upper position;

said float means comprising a vertically extending rod having a float on the lower end thereof and a flange positioned intermediate the ends thereof;

said limit switch arm being in engagment with said flange of said rod whereby said flange will move said switch arm upwardly to close said switch whenever said float moves to said upper position; and tube means connected to said outlet of said pump for directing water from said pump upwardly over said gunwales of said boat.

* * * * *